United States Patent [19]

Pollack

[11] 4,231,298

[45] Nov. 4, 1980

[54] SHELVING SYSTEM

[76] Inventor: Hyman Pollack, 41 Stonicker Dr., Lawrenceville, N.J. 08648

[21] Appl. No.: 22,582

[22] Filed: Mar. 21, 1979

[51] Int. Cl.[3] ..... A47B 57/06

[52] U.S. Cl. ..... 108/64; 108/111; 108/114

[58] Field of Search ..... 108/111, 109, 114, 64, 108/110; 211/191, 181

[56] References Cited

U.S. PATENT DOCUMENTS

| | | | |
|---|---|---|---|
| 2,919,816 | 1/1960 | Maslow | 108/111 |
| 2,919,817 | 1/1960 | Maslow | 108/111 |
| 3,146,735 | 9/1964 | Kesilman et al. | 108/111 |
| 3,225,720 | 12/1965 | Maslow | 211/181 |
| 3,252,434 | 5/1966 | Young | 211/181 |
| 3,507,399 | 4/1970 | Gruenberg | 108/111 |
| 3,835,793 | 9/1974 | Goddard | 108/109 |

*Primary Examiner*—Francis K. Zugel

*Attorney, Agent, or Firm*—Frederick A. Zoda; John J. Kane; Albert Sperry

[57] ABSTRACT

A shelving system, of the type adapted for swift assembly and disassembly, has an improved upright and shelf structure in which each shelf is swiftly attachable, without the use of tools, at its corners to transversely spaced posts of the upright. The upright is a ladder type, incorporating vertically spaced cross braces extending between vertical posts each of which comprises inner and outer post elements that allow insertion of a shelf without necessity of its being tilted or cocked. Each shelf is formed at its corners with right-angular, inwardly extending locking tongues or tabs, initially locatable, during assembly, in wide spaces defined between the inner and outer post elements. With the shelf in horizontal position, it is permitted movement downwardly from the wide spaces into narrower spaces in which the corners of the shelf lock, with the shelf being supported upon the cross braces of the uprights. Each upright is usable as a standard common to shelves adjoining each other at opposite sides of the upright, by formation of the upright posts with rectangularly spaced post elements defining side-by-side locking spaces while at the same time strongly reinforcing the uprights so that they may support heavy loads.

10 Claims, 7 Drawing Figures

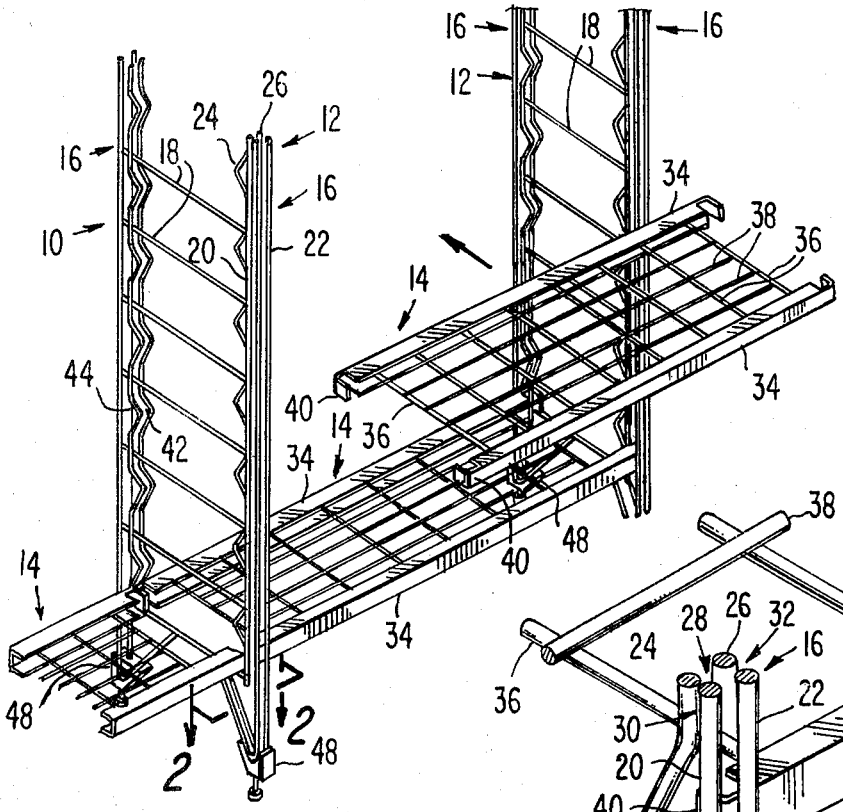
Fig. 1.
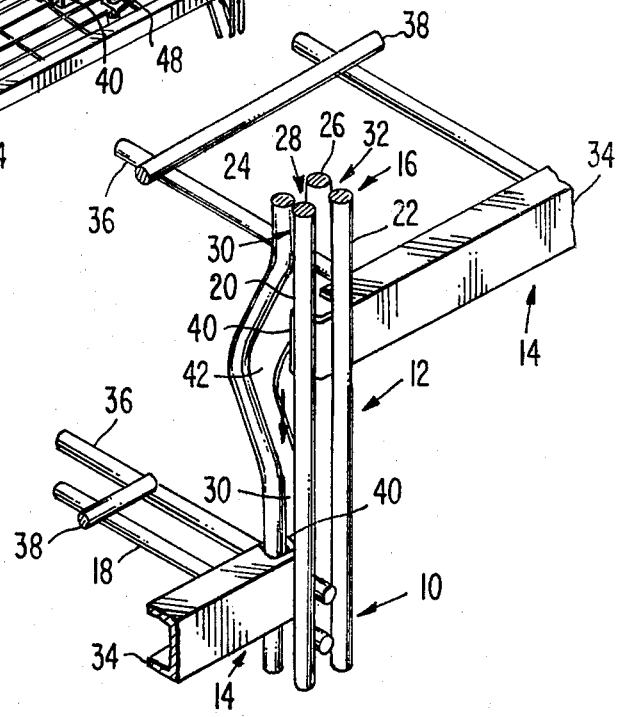
Fig. 2.
Fig. 3.
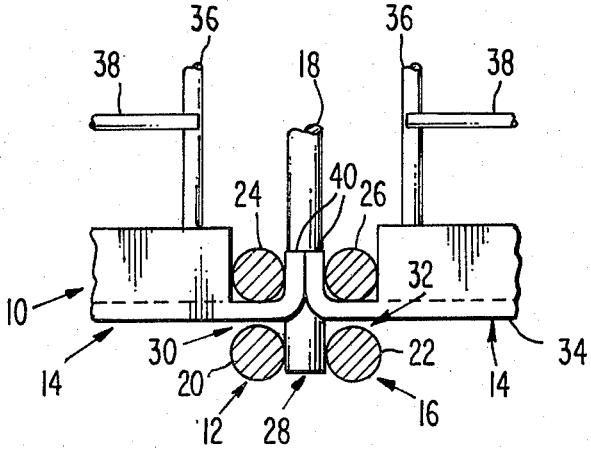

Fig. 4.
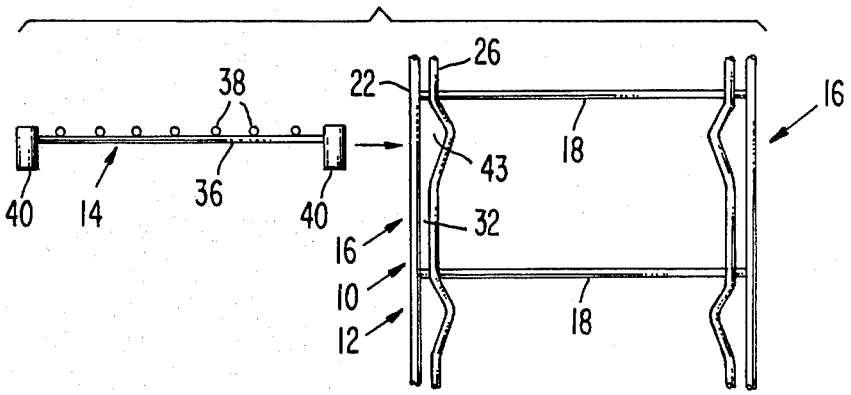
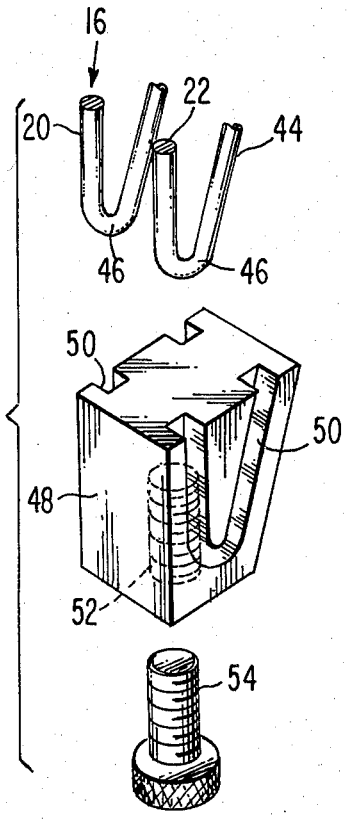
Fig. 7.
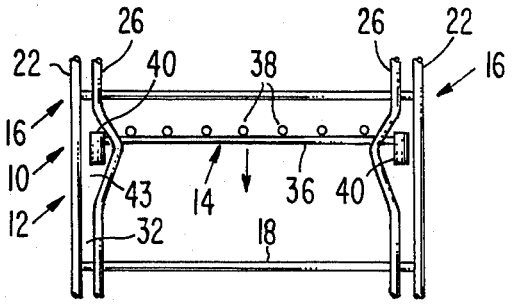
Fig. 5.
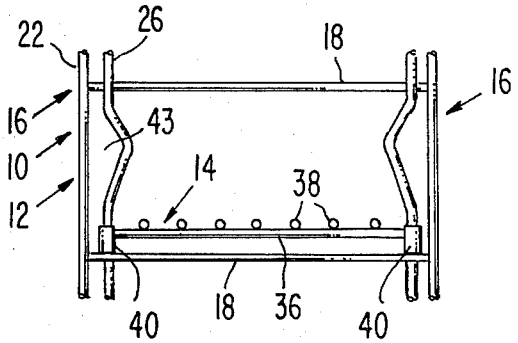
Fig. 6.

SHELVING SYSTEM

BACKGROUND OF THE INVENTION

1. Field of the Invention

The present invention relates generally to that type of shelving systems in which the shelving is formed largely of metal rods welded together and comprising, basically, uprights and shelves adapted to be separably assembled to produce shelving of selected length, height, depth, and with shelves in any desired number and vertical spacing. Shelving of this type is widely used in institutions such as hospitals, to provide sanitary supports for laundry or the like; in food service establishments, for supporting food products while assuring maximum visibility and cleanliness; and in a wide variety of manufacturing or other commercial establishments, to support replacement parts, warehoused or temporarily stored articles, documents, catalog items, and the like.

2. Description of the Prior Art

Shelving systems of the character described are, in and of themselves, well known. Typical of this type of shelving is the device disclosed, by way of example, in Kesilman et al U.S. Pat. No. 3,146,735; or Maslow U.S. Pat. No. 2,919,816. These patents, as is true also of the present invention, are concerned mainly with the provision of separable couplings or connections between the uprights and the shelves. They have, however, deficiencies which the present invention seeks to materially reduce or, eliminate in their entirety.

In prior art devices such as, for example, that disclosed in U.S. Pat. No. 3,146,735, it is necessary to cock or tilt the shelf during assembly, a feature regarded as undesirable in that excessive vertical space is required above the shelf being mounted, extreme care must be taken in positioning the shelf at the particular, tilted position preliminary to mounting, and undue care must also be exerted during the pivotal movement of the shelf to its final position. In U.S. Pat. No. 2,919,816 the same is true. In both of these patents, which are typical of the prior art, locking tabs are bent to face outwardly of the shelving structure, and by swinging of the shelf to its final position are disposable between side-by-side post elements so that a post element is confined between an outwardly facing locking tab and an adjacent abutment portion of the corner of the shelf.

In the prior art as typically represented by these patents, further, the outward facing of the locking tabs is regarded as undesirable in that the tabs represent under these circumstances projections that can snag articles or the clothing of workers. Still further, locking arrangements characteristic of the prior art are undesirably costly and complicated, adding materially to the cost of the shelving system.

SUMMARY OF THE INVENTION

Summarized briefly, the invention is similar to the prior art devices in respect to providing vertically disposed, transversely extending uprights of ladder-like configuration, readily fabricated from lengths of rod material welded together and cross braced at vertically spaced intervals to define correspondingly vertically spaced supports for the removable shelves. The present invention also includes shelves of the open frame type, comprising crossed, welded rods having locking means at the shelf corners for the purpose of detachably assembling the shelves with the uprights.

In accordance with the present invention, however, the locking means at the corners of the shelves are very simply formed, merely as right angular extensions of channeled longitudinal side rails or frame members. Cooperating with the locking tabs are posts on the uprights, each of which in the illustrated example comprises a series of rectangularly spaced post elements. The post elements are so formed and are so spaced as to define side-by-side spaces which, at a distance above each cross brace of the upright, is quite wide, so as to receive the locking tabs on the corners of a shelf without necessity of tilting or cocking of the shelf. Rather, the shelf may be inserted horizontally, in a plane only a few inches above the support against which it is to finally come to rest. The spaces that so receive the locking tabs are progressively reduced in a downward direction, merging into narrow, vertically extending locking areas into which the locking tabs move as the shelf is lowered to its final, supported position on the selected cross braces of the uprights.

In accordance with the invention, the locking tabs are extended inwardly so as to eliminate completely any outwardly facing projections that might catch upon clothing worn by or articles carried by a worker.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a fragmentary, partially exploded perspective view of a shelving system according to the present invention, one of the shelves being illustrated as it appears preliminary to its being inserted between the uprights for subsequent movement to its final position;

FIG. 2 is an enlarged, fragmentary, horizontal sectional view substantially on line 2-2 of FIG. 1, illustrating the manner in which the shelves are engaged at their corners with the uprights;

FIG. 3 is an enlarged, fragmentary perspective view also showing the connection of the shelves to the uprights, one of the shelves being in final position and another shelf being illustrated as it appears prior to movement to its final position;

FIG. 4 is a fragmentary end elevational view of one of the uprights, with a shelf being illustrated as it appears at an initial stage of mounting of the shelf upon the upright;

FIG. 5 is a view similar to FIG. 4 in which the shelf has been moved to an intermediate mounting stage;

FIG. 6 is a view similar to FIGS. 4 and 5 in which the shelf is illustrated in its final position in which it is fully assembled with the upright; and FIG. 7 is an enlarged, fragmentary, exploded perspective view illustrating the lower end of one of the uprights and an associated adjustable foot mount.

DETAILED DESCRIPTION OF THE PREFERRED EMBODIMENT

The shelving system or assembly comprising the present invention has been generally designated 10, and includes two basic components, namely the uprights 12 and shelves 14. All uprights used in the system can be and normally would be identically formed. The same is true of the shelves, thus facilitating mass production fabrication of the components of the shelving system by reducing the number of said components to a minimum, and by forming the same as standard shelving parts that can be ordered and assembled in any desired number, according to the needs of the particular customer.

Considering first the construction of the uprights, each of these is in the form of a ladder-like, open framework comprising, essentially, a pair of opposite but identical post assemblies generally designated 16 vertically disposed in transversely spaced, parallel relation; and a plurality of horizontally disposed, vertically spaced cross braces 18 extending between and rigidly secured to the respective post assemblies 16, 16.

Each post assembly is of strongly reinforced construction, including four, rectangularly spaced post elements 20, 22, 24, 26 (see FIGS. 2 and 3).

The post elements 20, 22 are disposed at the outside of each post assembly 16, that is, they comprise the post elements that face outwardly of each post assembly. Stating this otherwise, the post elements 20, 22 comprise first and second outer post elements respectively, and are disposed so as to define the exterior or outer edge of the post assembly 16 of which they are component parts.

The post elements 24, 26 in turn define first and second inner post elements respectively, being inner elements of a post assembly in that they are spaced inwardly from the outer elements 22, 24 in each upright 12.

As noted to particular advantage in FIGS. 2 and 3, the rectangular spacing of the post elements of each post assembly 16 defines a space 28 bounded on one side by the first outer and inner elements 20, 24 respectively. Space 28 is bounded on the other side thereof by the second outer and inner post elements 22, 26 respectively.

The rectangular spacing of the several post elements of each post assembly 16 further defines a side space 30 communicating with the center space 28, and bounded by the first outer post element 20 and the first inner post element 24. Similarly, opposite space 30 there is defined another side space 32, also communicating with the center space 28 and in this case defined by and between the second post elements 22, 26 respectively.

The rectangular spacing of the several post elements thus can be considered as defining, when the post assembly 16 is viewed in cross section as in FIG. 2, a cruciform locking space constituted by the center space 28 and the communicating side spaces 30, 32.

The rectangular spacing of the post elements, it may be noted, is produced by welding the ends of the cross braces 18 to the several post elements of each post assembly, with the ends of each cross brace extending between the first post elements 20, 24 on the one side of the cross brace, and the second post elements 22, 26 on the other side, as best seen in FIG. 2.

The cross braces 18 and the several post elements 20, 22, 24, 26 are all formed of stout metal rod material, and it will be understood that in the finished product, the uprights would be suitably plated. They may, for example, in a typical commercial embodiment be provided with a bright zinc chromate plated surface with an additional clear baked-on coating for added protection and for preservation of the bright appearance of the plated surfaces.

It may be noted that each post assembly 16 is identical to the other, being comprised of identical though oppositely arranged component rod members, hence standardizing and reducing the cost of production. Each upright, in fact, is identically formed at its opposite vertical side edges, so that it can be reversed side for side, and does not need special orienting during assembling of a complete shelving system.

Similarly, all the shelves 14 used in the shelving system may be identical to one another, again standardizing and reducing the cost of production. Each of said shelves includes, in the illustrated, preferred embodiment, a pair of identically formed but oppositely arranged longitudinal frame members in the form of channels, which can be constructed of stainless steel or may, if desired, be suitably plated, according to the needs or desires of the particular user. The longitudinal frame members are designated 34, and are welded or otherwise made rigid with cross members 36 spaced along the length of the longitudinal frame members, and formed of metal rod material. The cross members 36 extend transversely between the frame members 34, and are welded to longitudinal rod members 38 disposed in parallel relation to the longitudinal frame members 34 and cooperating with the cross members 36 to form an open grid between the frame members 34, 34 of each shelf 14.

Each longitudinal frame member 34, at its ends, is integrally formed with right-angled tabs or locking tongues 40, formed as extensions of the web portion of each frame member, and having distal portions bent inwardly of the shelf as best seen from FIG. 2. The locking tongues 40 cooperate with the post elements 20, 22, 24, 26 of each post assembly 16 to form an interlocking engagement between the corners of each shelf and the post assemblies 16 of uprights 12 disposed adjacent the opposite ends of the shelf.

It may now be noted that the outer post elements 20, 22 of each post assembly 16 are of straight formation over the full distance of the uprights utilized for shelf support, that is, the full distance of the uprights spanned by the cross braces 18 (which are used as support surfaces for the shelves). The inner post elements 24, 26, on the other hand, are formed at uniformly spaced intervals with angular bends or crimps defining reentrant angles opening toward the straight outer post elements 20, 22 adjacent thereto. In the illustrated embodiment, the angularly bent portions are disposed immediately below each cross brace 18 (see FIGS. 1 and 4–6), and as a result, the side spaces 30, 32, in the area immediately below each cross brace 18, are substantially widened as at 42, 43 respectively, with the widened portions of the side spaces being progressively reduced in a downward direction to define the narrowest portions of the side spaces, the narrowest portions being disposed immediately above the next lower cross brace 18 and being little greater than the thickness of the locking tabs 40 of the shelves.

The widened portions 42, 43 of the side spaces are sufficiently wide, at their greatest dimension, to accommodate the entire locking tab of a shelf without contacting the same, as will be readily noted from FIG. 5.

At their lower ends, the respective post assemblies 16 are provided with means for facilitating height adjustment of the upright. To this end (see FIG. 7), the lower end portions of the respective outer post elements 20, 22 of each post assembly 16 are formed with inwardly and upwardly inclined extensions 44, whereby to define side by side, parallel, spaced, triangular feet 46.

Each foot of an upright is provided with a support block 48 having at its opposite sides angular, outwardly facing side recesses 50. The feet 46 can be sprung apart to engage within the respective recesses 50. In the underside of each block 48 there is formed a downwardly opening, threaded recess 52, in which is engaged a correspondingly threaded adjustment bolt 54. Bolt 54 can be threaded inwardly or outwardly as necessary, to provide for a proper height and/or leveling adjustment.

In use of the shelving system, the shelves are assembled with the uprights without the necessity of cocking or tilting the shelves. All that is necessary is that one end of a shelf unit, preferably the lowermost unit, be moved horizontally inwardly from the position shown in FIG. 4, at the level of the widened portions 42, 43. When the shelf has been moved inwardly in this horizontal plane, it will be positioned as in FIG. 5, with the tongues 40 disposed in said widened portions 42 or 43 as the case may be. Then, the shelf is simply moved downwardly as shown by the arrows in FIG. 5 to its final position shown in FIG. 6. As it moves downwardly, the space between the outer and inner post elements progressively narrows, until the locking tongues 40 move into the narrowest portions of the spaces 32, viewing the same as in FIGS. 4 through 6. In this position of the shelf, the locking tongues 40 thereof embrace the inner post elements 26 (see the right hand shelf in FIG. 2).

At the opposite side of the same upright, a shelf can be mounted at the same level, as shown in FIG. 2. In this case, the locking tongue 40 would enter the widened space 42 defined between post elements 20, 24, and would move downwardly into the narrowest part of space 30, to the position shown for the left hand shelf of FIGS. 2 and 3. In these circumstances, the distal ends of the locking tongues of the adjoining shelves (see FIG. 2) are substantially in face-to-face contact with each other, and almost completely fill the center space 28, between the inner post elements 24, 26, providing a snug, secure interlocking engagement between the common upright and the shelves at each side thereof.

The same procedure is followed for successively higher shelves, with any shelf being located at any desired elevation, that is, upon any selected cross brace 18. A shelving system as illustrated and described can, of course, be extended for any desired length, adding upright after upright along a wall in a manner found desirable in many institutional and manufacturing, warehousing, or other commercial environments where large volumes of articles must be stacked or stored.

In every instance, it is not necessary that a shelf be cocked or tilted for the purpose of mounting it between adjacent uprights. Rather, it is simply moved into the space between the uprights. If both uprights are already in position as shown, for example, in FIG. 1, the uprights would be sprung apart slightly by the shelf, as it moves from the FIG. 4 to the FIG. 5 position. The extent to which each upright is required to yield outwardly to permit the shelf to enter into the space between the uprights is no more than the length of one of the locking tabs, and this is readily permitted, because the uprights have some springiness despite their substantial rigidity and in addition, because there is a slight yieldability or relative movement between the uprights and the shelves, in the area of the locking connections shown in FIG. 2. In some instances, the necessity of uprights yielding to permit entry of shelves is dispensed with completely, as for example, when the several shelves are connected to a single upright, after which a second upright is added at the other ends of the shelves, followed by connection of another series of shelves to the second upright, followed in turn by the addition of a third upright at the free ends of the newly added shelves, etc.

The invention is further highly desirable not only in the relative simplicity of the locking connection, which requires no more than the formation of right angular tongues on the ends of the shelves, but also in that no tools are required, the locking tongues are faced inwardly to eliminate undesirable projections, and the number of crevices in which food or dirt particles may lodge is held to a minimum.

Still further, the invention is highly desirable in that after assembly and after the shelving system is in use supporting articles of various kinds, a particular shelf can be readily adjusted vertically to a new position, without disturbing adjacent shelves. All that is necessary is that the shelf be lifted upwardly, while being kept horizontal, until its locking tongues move into the widened portions 42, 43 of the locking spaces 30, 32. Then, the uprights can be caused to yield slightly to permit the shelf to be moved out horizontally and repositioned at its new location. Or, the shelf can be tilted longitudinally to a slight degree, with its locking tongues remaining in the widened portions 42 of one upright, while being moved out of the widened portions 43 of the other upright, again sufficiently to permit removal of the shelf without disturbing shelves immediately and below the same. This removal of a single shelf from a space between shelves that are already in place above and below it is not normally feasible with shelves that must be tilted transversely as in the above-mentioned patents, unless of course the space between the shelves next above and below the removed shelf is quite large.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A shelving system comprising (a) at least two uprights each of which includes a pair of post assemblies at opposite sides thereof and vertically spaced cross braces extending between and joined to the post assemblies, the several post assemblies being disposed at rectangularly spaced corners of said system, each corner post assembly comprising at least one outer and one inner post element spaced closely from each other and relatively formed to define between them a plurality of side locking spaces occurring at each of said corners at selected, vertically spaced intervals along the length of the elements of the post assembly provided at said corner; and (b) at least one rectangular shelf including an angular locking tongue at each corner thereof, each locking space having a widened upper part adapted to loosely receive said locking tongue and merging into a narrower lower part adapted to lockingly engage said tongue in a position in which the tongue is confined between the inner and outer post elements of the post assembly provided at said corner, and is in embracing relation to one of said elements.

2. A shelving system as in claim 1 wherein one of said post elements of each corner post assembly is of straight formation over the full length of each locking space, the other post element of the same corner post assembly having an angular bend above each cross brace defining, in cooperation with said one post element, said widened upper part of the locking space.

3. A shelving system as in claim 1 in which the locking tongue is bent inwardly of the upright in embracing relation to the inner element of the corner post assembly with which the tongue is lockingly engaged.

4. A shelving system as in claim 1 in which the locking tongue is of right-angular form, and has a distal portion bent inwardly of the upright in embracing relation to one of said post elements of the corner locking assembly with which the tongue is lockingly engaged, the tongue being engaged by the other post element of said assembly against movement out of embracing relation to said one element, when the tongue is engaged in the narrower lower portion of the locking space.

5. A shelving system as in claim 1 wherein each post assembly is formed with two side-by-side pairs of post elements, the two pairs of post elements of each assembly being identically formed and being closely spaced apart whereby to define side-by-side locking spaces each of which comprises one of said side spaces and is adapted to receive the locking tongue of an associated shelf, whereby each upright is adapted to comprise a standard common to shelves supported at a common level at opposite sides thereof, the locking tongues of said shelves being disposed side-by-side and having contiguous distal portions confined between corresponding post elements of the two pairs of said elements of the corner post assembly in which the side-by-side tongues are engaged.

6. A shelving system as in claim 5 wherein the post elements of each of said corner post assemblies are rectangularly spaced and comprise first and second outer post elements and first and second inner post elements, the first post elements being spaced from the second post elements by said cross braces to define a center space in each post assembly, the locking tongues of adjacent shelves supported in common by one of said uprights having their distal portions entering said center space in the cross-brace-supported position of the shelves.

7. A shelving system as in claim 6 wherein the first and second post elements of each post assembly are spaced apart, the second post elements of each assembly being correspondingly spaced to locate said side spaces in communication with the center space of the post assembly.

8. A shelving system as in claim 7 in which each locking tongue has a proximal portion adapted to be received in one of said side spaces with the distal portion of the same locking tongue being disposed in the center space, in the supported position of the shelf.

9. A shelving system as in claim 8 in which said center space is of a constant width over the full distance between adjacent cross braces and is of a width corresponding to the thickness of each cross brace.

10. A shelving system as in claim 9 in which the side spaces are formed with said widened parts adjacent one cross brace and are formed with the narrower parts adjacent the cross brace next below said one cross brace.

* * * * *